US006726265B2

(12) United States Patent
Miller

(10) Patent No.: US 6,726,265 B2
(45) Date of Patent: Apr. 27, 2004

(54) GOLF DISC RETRIEVER

(76) Inventor: Darrin M. Miller, 1850 Oleander DR, Conover, NC (US) 28613

( * ) Notice: Subject to any disclaimer, the term of this patent is extended or adjusted under 35 U.S.C. 154(b) by 0 days.

(21) Appl. No.: 10/160,778

(22) Filed: Jun. 1, 2002

(65) Prior Publication Data

US 2004/0061347 A1 Apr. 1, 2004

(51) Int. Cl.[7] ..... A63B 47/02
(52) U.S. Cl. ..... 294/66.1; 294/19.2
(58) Field of Search ..... 294/19.2, 66.1, 294/66.2; 56/8; 37/314–316; 473/286

(56) References Cited

U.S. PATENT DOCUMENTS 3,276,807 A * 10/1966 Ward ..... 294/66.1
3,756,644 A * 9/1973 Rydberg ..... 294/66.1
4,774,804 A * 10/1988 Sands ..... 56/400.04
5,110,168 A * 5/1992 Petrillo ..... 294/19.2
5,328,220 A * 7/1994 McPherson ..... 294/19.2
5,368,350 A * 11/1994 Ader et al. ..... 294/19.2
5,511,841 A * 4/1996 Allen ..... 294/66.1
5,823,591 A * 10/1998 Rubinstein ..... 294/19.2

* cited by examiner

*Primary Examiner*—Dean J. Kramer
(74) *Attorney, Agent, or Firm*—Donald W. Meeker

(57) ABSTRACT

A disc retriever for disc golf is attached to a rope or cord which can be thrown varying distances to enable retrieval of a golf disc from variously sized water hazards or other difficult to access locations. The golf disc retriever is comprised of a rectangular flat wire frame, which has an opening large enough to admit and retain a golf disc, two pivoting arms which will fold into the rectangle frame and pivot forward to form lead arms interconnected by a long pull rope or cord used to pull the golf disc through a water hazard with the frame upright. The arms can be folded flat in line with the frame and the rope can then be easily and rapidly wound around the folded disc retriever frame in order to fit into a pocket of a golf disc bag or any other kind of carrying sack.

2 Claims, 1 Drawing Sheet

GOLF DISC RETRIEVER

BACKGROUND OF THE INVENTION

1. Field of the Invention

The present invention relates to retrievers for sports objects and in particular to a long distance retriever for golf discs which folds up to fit in a pocket of a golf disc bag or any other kind of carrying sack.

2. Description of the Prior Art

Disc golf is gaining popularity and more courses are being set up to offer this alternative to traditional golf. The same primary obstacle exists on both of these courses: the water hazard. Many golf balls are lost in water hazards. Often the golf players don't even attempt to retrieve them. But a golf disc costs many times the price of a golf ball and they are significantly larger. Golf discs are not meant to be disposable and would create unnecessary debris if left behind on a course. The players in disc golf are also far less likely to be carrying as many discs as traditional golfers carry golf balls.

Therefore the disc golfer is far more likely to want to retrieve discs which fly into water hazards, as well as flying into other difficult to access locations.

There have been many attempts to provide golf ball retrievers. None of them would be very effective in retrieving golf discs.

U.S. Pat. No. 3,276,807, issued Oct. 4, 1966 to Ward, indicates a golf ball retriever with a rectangular frame and back rail with a triangulated wire lead and a pull line, for capturing and retrieving golf balls.

U.S. Pat. No. 5,511,841, issued Apr. 30, 1996 to Allen, shows a golf ball retriever device and method of using same for recovering golf balls from a water hazard. The device comprises an open frame portion having a pair of longitudinal frame members and a plurality of interconnecting ball catching members. The ball catching members are spaced to entrap golf balls while allowing smaller objects in the water hazard to pass through. The device further includes an extension portion having a tie end located forwardly of the open frame portion. A tether cord of a predetermined length is attached to the tie end of the extension portion. After being thrown into the water hazard to a location beyond the golf ball to be retrieved, the tether cord is pulled so that the golf ball is entrapped and thereby recovered. The extension portion helps the device maintain a correct orientation while it is pulled without digging into the soft bottom of the water hazard. Preferably, the extension portion is also removable so that the device can be made compact for storage.

U.S. Pat. No. 3,756,644, issued Sep. 4, 1973 to Rydberg, is for a drag scoop and line for retrieval of golf balls from water hazards using parallel top and bottom plates and side rails.

U.S. Pat. No. 4,984,836, issued Jan. 15, 1991 to Redding, provides a rugged self-contained tool for performing golf ball retrieval from remote and otherwise inaccessible areas of a water hazard comprising a plurality of rigidly mounted, ball-pinching, spaced, resilient discs upon an axle supported rotatably by and between the ends of a one-half rectangular cooperating ball-confining frame. The tool can be deployed by casting same into remote or otherwise inaccessible areas retaining control thereof by means of a cord attached to an eyelet centrally located on the frame, which cord, when pulled steadily, rolls the tool upon the bottom of the water hazard returning the tool and its retained contents to the user. The frame of the tool provides hydroplaning downward pressure on the tool and the discs have multiple straight sides at their outer peripheries to provide traction with the bottom.

U.S. Pat. No. 5,368,350, issued Nov. 29, 1994 to Ader, claims an improved multiple purpose golf ball retriever for retrieving golf balls from water hazards. The device comprises an elongated head which has a forward frame, rear frame, upper frame and side frames. The elongated head's handle mount can be permanently attached to a telescoping handle. The telescoping handle is attached to the handle mount on the upper frame offset from its center at a compound angle which aids capturing the ball in the raking mode while also facilitating the use of a wood or putter cover and ease of storage in the golf bag. The side frames inside diameters are slightly smaller than a golf ball which enables the golf ball retriever to capture the ball by going down over the ball from either side at any angle. The retriever can be used as a rake in clear or blind locations and from either side at any angle for clear water or rocky weedy and hazardous water areas that restrict the raking action.

U.S. Pat. No. 5,110,168, issued May 5, 1992 to Petrillo, describes a golf ball retriever includes a head part having a forward frame part and a rear frame part. The forward frame part has upper and lower parallel leading members defining a rectangular mouth opening sufficiently wide to allow a retrieved golf ball to enter. The rear frame part has a lower trailing member which defines a rear seat edge parallel to the lower leading member. The seat edge is spaced from the lower leading member a distance slightly less than the diameter of a golf ball. Retrieved golf balls that enter the mouth opening are then seated or cradled securely between the rear seat edge and the lower leading member, and will thus tend to remain in place as the retriever continues to be moved about. A detachable handle, which may include a golf club or a telescoping pole, can be easily clamped to the head part when needed. Tooth-like projections extending from the forward leading member help to dislodge golf balls embedded in land or out of view in the bottom surface of a pond. The projections can also serve as a sand rake.

U.S. Pat. No. 5,328,220, issued Jul. 12, 1994 to McPherson, discloses a ball retriever for retrieving a ball has a handle receiving member and at least two parallelly disposed ovoid ball barriers attached to the handle receiving member. At least one ball restraining member is attached to at least one ball barrier. At least two ball barrier support members connect the ball barriers. A ball receiving chamber, having a ball receiving port, is formed by the ball barriers and the ball restraining member. A handle lock mechanism, on the handle receiving member, releasably locks an extendible handle to the handle receiver.

U.S. Pat. No. 5,823,591, issued Oct. 20, 1998 to Rubinstein, indicates a golf ball retriever having a dual entry for receiving a golf ball. In an exemplary embodiment, the golf ball retriever includes a substantially rectangular open wire frame head having a plurality of sufficiently closed sides forming a receiving area capable of retaining a golf ball substantially therein and two openings on adjacent perpendicular sides that are capable of receiving a golf ball therethrough and into the receiving area.

While many of these golf ball retrievers are effective for retrieving golf balls, they would not work to retrieve a flat large diameter golf disc. What is needed is a golf disc retriever for dredging water hazards for lost golf discs.

SUMMARY OF THE INVENTION

An object of the present invention is to provide a golf disc retriever which can be thrown varying distances to enable retrieval of a golf disc from a large, medium or small water hazard.

A related object of the present invention is to provide a golf disc retriever which effectively dredges the bottom of water hazards to scoop up a golf disc, capturing and holding the disc in an upright horizontally elongated rectangular frame with elongated triangular arms attached to a long line for pulling the disc through the water.

An added object of the present invention is to provide a golf disc retriever with a flat wire frame and two pivotable triangular wire leads that pivot forward to receive the rope tied through a loop at the end of each lead for pulling the disc retriever and pivot down flat on the rectangular frame so that the cord may be wrapped around the folded flat retriever for easy and rapid storage and transport in a pocket of a golf disc bag or any other kind of carrying sack.

Another object of the present invention is to provide a golf disc retriever wherein the triangulated pivotable leads are sized and angled to enable the frame to ride through the water along the bottom of the hazard with the frame in an upright horizontally elongated orientation to capture the golf disc.

A beneficial object of the present invention is to provide a golf disc retriever sized slightly smaller than a traditional golf disc so that the rectangular frame may effectively capture a lost disc by not allowing the disc to entirely pass through the rectangular opening.

In brief, a rectangular flat wire frame has an opening large enough to admit and retain a golf disc in the rectangle. Thick wired triangular leads each have wrapped wire connections around the vertical ends of the frame adjacent to a top and bottom horizontal members of the frame to permit pivoting of the triangular leads between a flat with the frame storage position and a forward extended position with the two triangular leads touching at a forward end. A rope is tied through a loop at the forward end of each triangular lead. The disc retriever is thrown into the water hazard just beyond the position of the lost disc in the water. The rope pulls the retriever back through the water horizontally along the bottom of the water hazard and the retriever scoops up and retrieves the disc by capturing the disc in the upright horizontally elongated rectangular frame.

An advantage of the present invention is to provide a golf disc retriever which can be thrown varying distances to enable retrieval of a golf disc in the middle of a large, medium or small water hazard.

Another advantage of the present invention is to provide a golf disc retriever which effectively dredges the bottom of water hazards to scoop up a golf disc, capturing and holding the disc in an upright horizontally elongated rectangular frame.

A related advantage of the present invention is the adaptability of the long leader line, for pulling the golf disc, to varying golf course conditions such as water hazard depth and distance.

A practical advantage of the present invention is the golf disc retriever rectangular frame and two pivotable triangular wire leads which pivot down flat on the rectangular frame so that the cord may be wrapped around the folded flat retriever with ease and rapidity during a Frisbee golf game for easy storage and transport in a pocket of a golf disc bag or any other kind of carrying sack.

One more advantage of the present invention is to provide a golf disc retriever wherein the triangulated pivotable leads are sized and angled to enable the frame to ride through the water along the bottom of the hazard with the frame in an upright horizontally elengated orientation to capture the golf disc.

Yet another advantage of the present invention is to provide a golf disc retriever sized slightly smaller than a traditional golf disc so that the rectangular frame may effectively capture a lost disc by not allowing the disc to entirely pass through the rectangular opening.

BRIEF DESCRIPTION OF THE DRAWINGS

These and other details of my invention will be described in connection with the accompanying drawings, which are furnished only by way of illustration and not in limitation of the invention, and in which drawings.

BEST MODE FOR CARRYING OUT THE INVENTION

Figure 1:
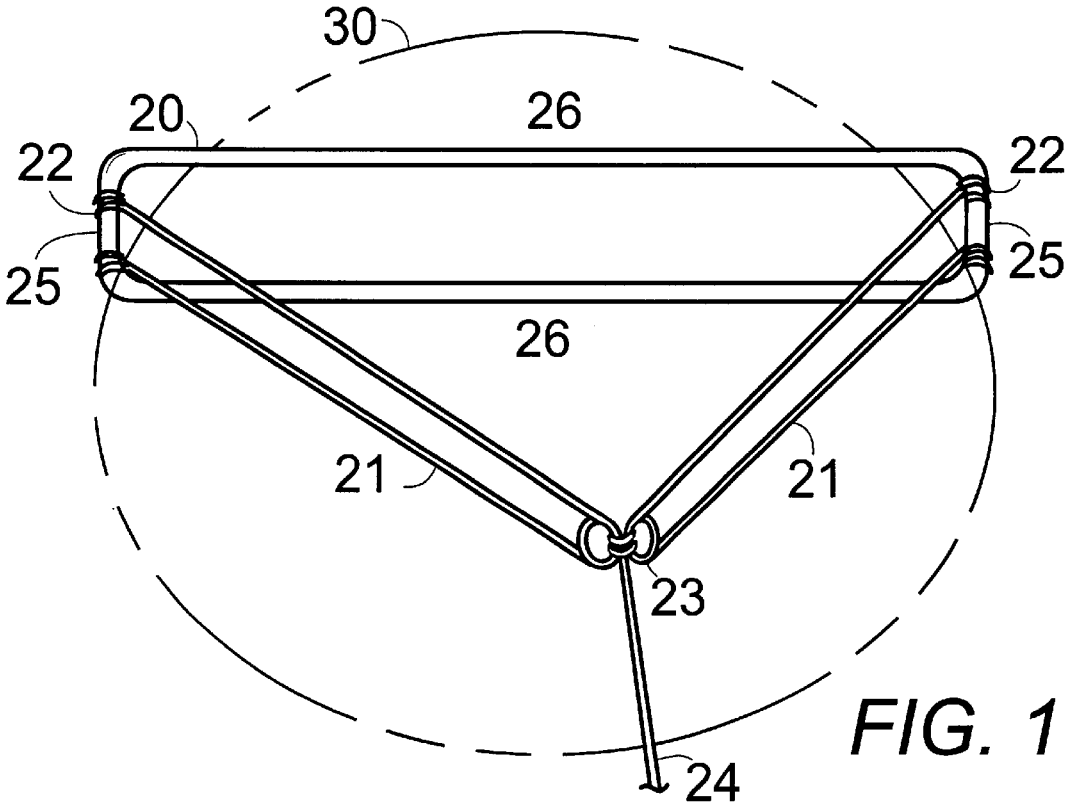
FIG. 1 is a front perspective view of the golf disc retriever in the pulling configuration with a golf disc in tow.
Figure 2:
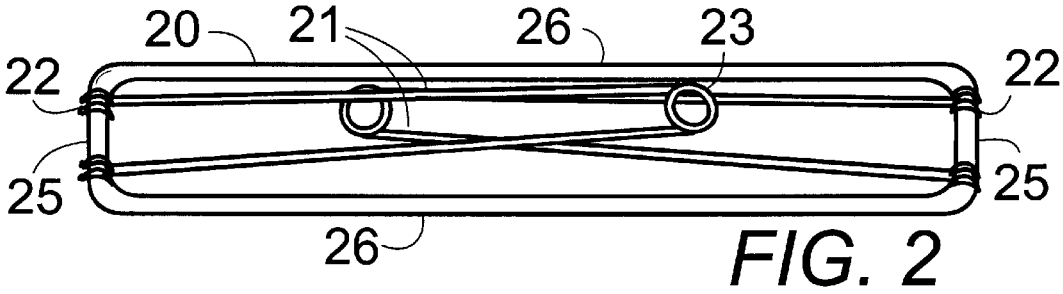
FIG. 2 is a front elevational view of the frame with the two triangular lead arms folded flat against the frame.
Figure 3:
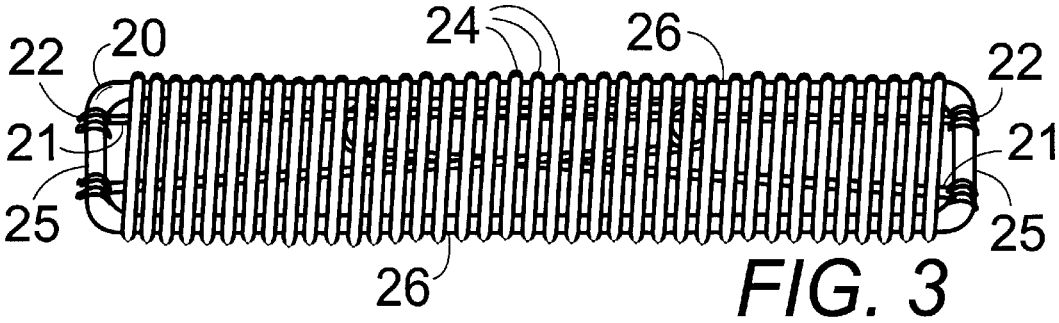
FIG. 3 is a front elevational view of the frame with the two triangular lead arms folded flat against the frame and the rope wrapped around the frame and lead arms in a flat configuration for storage.

In FIGS. 1–3, a golf disc retriever device for retrieving golf discs from water hazards and other locations comprises a flat rigid rectangular frame 20, two pivotable lead arms 21, and a pulling means, such as a rope 24.

In FIGS. 1–3, a rigid rectangular frame 20 having a pair of spaced horizontal members 26 slightly shorter in length than the diameter of a golf disc and two spaced vertical members 25 interconnecting the horizontal members 26. The vertical members 25 each have a length slightly greater than the thickness of a golf disc. The center opening in the frame is sufficiently large to admit and retain a golf disc therein.

In FIGS. 1–2, a lead arm 21 is attached by a pivotable means 22 to each of the vertical members 25 of the frame 20. Each of the lead arms 21 is capable of folding flat within the frame 20 for storage and pivoting outwardly to contact the other lead arm 21. Each of the lead arms 21 has a means such as a circular opening 23 for engaging with a pulling means, such as a rope or cord 24.

In FIG. 1, a pulling means 24 is capable of engaging the two lead arms 21 to pull the device homeward when retrieving an errant golf disc.

In FIGS. 1–2, each of the lead arms 21 is comprised of a rigid wire structure and the means for engaging with a pulling means 24 comprises an outer circular bend 23 formed in the wire structure at an outer end of the lead arm 21. This circular configuration 23 is capable of receiving the pulling means 24 tied through the circular configurations 23 of both lead arms21.

In FIGS. 1–2, the pivotable means 22 of attaching the lead arm 21 to the vertical members 25 is comprised of at least one inner circular bend 22 in an inner end of the lead arm 21 loosely encircling the vertical member 25 to allow pivoting of the lead arm 21.

In FIG. 1, the lead arm 21 is formed in a triangular configuration, having two ends with at least one inner circular bend 22 in each of the two ends to encircle the vertical member 25 of the frame 20.

In FIGS. 1 and 3, the pull means 24 is comprised of an elongated flexible cord-like element which is capable of being inserted through the outer circular bends 23 of both of the lead arms 21. The pull means 24 is secured thereto to hold the two lead arms 21 together in front of the frame 20 with the cord-like element 24 being capable of pulling the frame 20 to capture the golf disc 30 (shown dashed).

In FIG. 3, the cord-like element 24 is capable of being wrapped around the device along the horizontal members 26 with each of the lead arms 21 folded flat within the frame 20 for storage.

It is understood that the preceding description is given merely by way of illustration and not in limitation of the invention and that various modifications may be made thereto without departing from the spirit of the invention as claimed.

What is claimed is:

1. A golf disc retriever device for retrieving golf discs from water hazards and other locations, the device comprising:

a rigid rectangular frame comprising a single rigid element formed in a single plane into a flat rectangular shape having a pair of spaced horizontal members slightly shorter in length than the diameter of a golf disc and two spaced vertical members interconnecting the horizontal members, the vertical members each having a length slightly greater than the thickness of a golf disc, the vertical members spaced apart by a distance less than a diameter of a golf disc to form a center opening adapted to admit and retain a golf disc therein;

a lead arm attached by a pivotable means to each of the vertical members of the frame, each of the lead arms adapted to fold flat within the frame for storage and pivoting outwardly to contact the other lead arm and each of the lead arms having a means for engaging with a pulling means, each of the lead arms comprising a rigid wire structure formed in a triangular configuration having two ends spaced apart, each of the two ends having a portion of the wire bent into a circular configuration adapted to encircle one of the vertical members pivotable means to form a pivotable means of attaching the lead arm to the vertical member and each of the lead arms having the means for engaging with a pulling means comprising an outer circular bend formed in the wire structure at an outer end of the lead arm, the circular configuration adapted for receiving the pulling means;

a pulling means capable of engaging the two lead arms and pulling the device to retrieve a golf disc therein, wherein the pulling means comprises an elongated flexible cord-like element which is capable of being inserted through the outer circular bends of both of the lead arms and being secured thereto to hold the two lead arms together in front of the frame, the cord-like element adapted for pulling the frame to capture the golf disc, and the cord-like element further adapted for being wrapped around the device along the length of the device with each of the lead arms folded flat within the frame for storage.

2. The device of claim 1 wherein the triangulated pivotable lead arms are sized and angled from the rigid horizontal frame to enable the rigid rectangular frame to ride through a water hazard along the bottom of the hazard with the rigid rectangular frame in an upright elongated orientation to capture a golf disc from the bottom of a water hazard in the horizontal frame.

* * * * *